United States Patent [19]

Ide

[11] Patent Number: 4,966,529

[45] Date of Patent: Oct. 30, 1990

[54] STROKE DETECTION CORRECTING SYSTEM FOR VARIABLE DISPLACEMENT TYPE COMPRESSOR

[75] Inventor: Yutaka Ide, Wako, Japan

[73] Assignee: Honda Giken Kogyo Kabushiki Kaisha, Tokyo, Japan

[21] Appl. No.: 412,050

[22] Filed: Sep. 25, 1989

[30] Foreign Application Priority Data

Sep. 26, 1988 [JP] Japan ..... 63-240285

[51] Int. Cl.[5] ..... F04B 9/00

[52] U.S. Cl. ..... 417/218; 417/222

[58] Field of Search ..... 417/412, 418, 422, 422 S

[56] References Cited

U.S. PATENT DOCUMENTS 4,655,689 4/1987 Westveer et al. ..... 417/222 X
4,708,596 11/1987 Palm et al. ..... 417/222 X
4,737,079 4/1988 Kurosawa et al. .
4,886,422 12/1989 Takeuchi et al. ..... 417/218 X

FOREIGN PATENT DOCUMENTS

3500299Al 11/1985 Fed. Rep. of Germany .

OTHER PUBLICATIONS

"Industriellen Messetchnik", Profos, Vulkan-Verlag--Essen, 1987, pp. 237, 263 and 264.

"Lexikon der Elektronik", Neufang, Friedr. Vieweg & Sohn, 1983, p. 186.

"Kleines Lexikon der Bertriebsmesstechnik", Jeschke, Reihe Automatisierungstechnik, 1968, pp. 42 and 43.

*Primary Examiner*—John C. Fox

*Attorney, Agent, or Firm*—Armstrong, Nikaido, Marmelstein, Kubovcik & Murray

[57] ABSTRACT

A stroke detection correcting system for variable displacement type compressors comprises a variable displacement type compressor including a plurality of working pistons operatively connected to an internal combustion engine and variable in stroke, a stroke detecting device for detecting the operation stroke of the working pistons, a switching device for changing the switching mode when the stroke of each working piston is in a given range previously set, and a correcting circuit for correcting the detected value from the stroke detecting device on the basis of a predetermined value in accordance with the changing of the switching mode of the switching device. This makes it possible to correct the detected value from the stroke detecting device on the basis of the actual operation stroke of the working piston to provide a substantially correct stroke value, regardless of an error of attachment of and a deterioration with age of the stroke detecting device.

3 Claims, 3 Drawing Sheets

72
E
C
57
71
S
Monostable circuit
73
So
74
ΔSn
Averaging circuit
75
76b
L
H
76
76a
76c
78
ΔSn-1
Storage circuit
77
Upper and lower limit processing circuit
79
ΔSM
80
Storage circuit
81
Subtraction circuit
82
S'

STROKE DETECTION CORRECTING SYSTEM FOR VARIABLE DISPLACEMENT TYPE COMPRESSOR

BACKGROUND OF THE INVENTION

1. Field of the Invention

The field of the present invention is stroke detection correcting systems for variable displacement type compressors.

2. Description of the Prior Art

Such stroke detection correcting systems are conventionally known, for example, from Japanese Patent Application Laid-open No. 218670/87, in which a stroke detecting means is attached to a variable displacement type compressor, so that the control of the operation stroke of a working piston is conducted on the basis of a detected value from the stroke detecting means.

In such a system, the detected value from the stroke detecting means may deviate from the actual stroke of the working piston due to an error of attachment of the stroke detecting means at an attaching stage, or deterioration with age of the stroke detecting means. If such a deviation occurs, the control of the operation stroke of the working piston is inaccurate. When the operation of the compressor is started during idle speed rotation of an internal combustion engine, there is a problem that the idling rpm of the engine cannot be properly controlled.

SUMMARY OF THE INVENTION

The present invention has been accomplished with such circumstances in view, and it is an object of the present invention to provide a stroke detection correcting system for a variable displacement type compressor, in which the detected value from the stroke detecting means can be corrected to provide proper control at all times.

To attain the above object, according to the present invention, there is proposed a stroke detection correcting system for variable displacement type compressors, comprising a variable displacement type compressor including a plurality of working pistons operatively connected to an internal combustion engine and variable in stroke, stroke detecting means for detecting the operation stroke of the working piston, switching means for changing the switching mode when the stroke of each working piston is in a given previously set range, and correcting means for correcting the detected value from the stroke detecting means on the basis of a predetermined value in accordance with the changing of the switching mode of the switching means.

With the above construction, by an arrangement such that the switching mode of the switching means is changed when the stroke of the working piston is in the previously set range of values, the now detected value from the stroke detecting means can be corrected by the set value.

In addition to the above construction, if the switching means comprises a pressure switch whose switching mode is changed when the discharge pressure from the variable displacement type compressor is more than a given value, the discharge pressure from the variable displacement type compressor corresponds to the stroke of the working piston and hence, it can be detected by the pressure switch that the stroke of the working piston is in the given range.

Further, in the above construction, if the switching means is arranged so that the switching mode may be changed with the maximum discharge pressure from the variable displacement type compressor, and the correcting means is arranged so that the detected value may be corrected by the time when a given time has elapsed after changing of the switching mode of the switching means, the maximum stroke is maintained for a given time from the changing of the switching mode of the switching means, upon variation of the stroke of the working piston, prior to the variation of discharge pressure from the variable displacement type compressor. By effecting the correction of the detected value from the stroke detecting means within a given time from the changing of the switching mode of the switching means, it is possible to provide a good accurate correction.

The above and other objects, features and advantages of the invention will become apparent from a reading of the following description of the preferred embodiment, taken in conjunction with the accompanying drawings.

BRIEF DESCRIPTION OF THE DRAWINGS

Drawings illustrate one embodiment of the present invention, wherein.

DESCRIPTION OF THE PREFERRED EMBODIMENT

Figure 1:
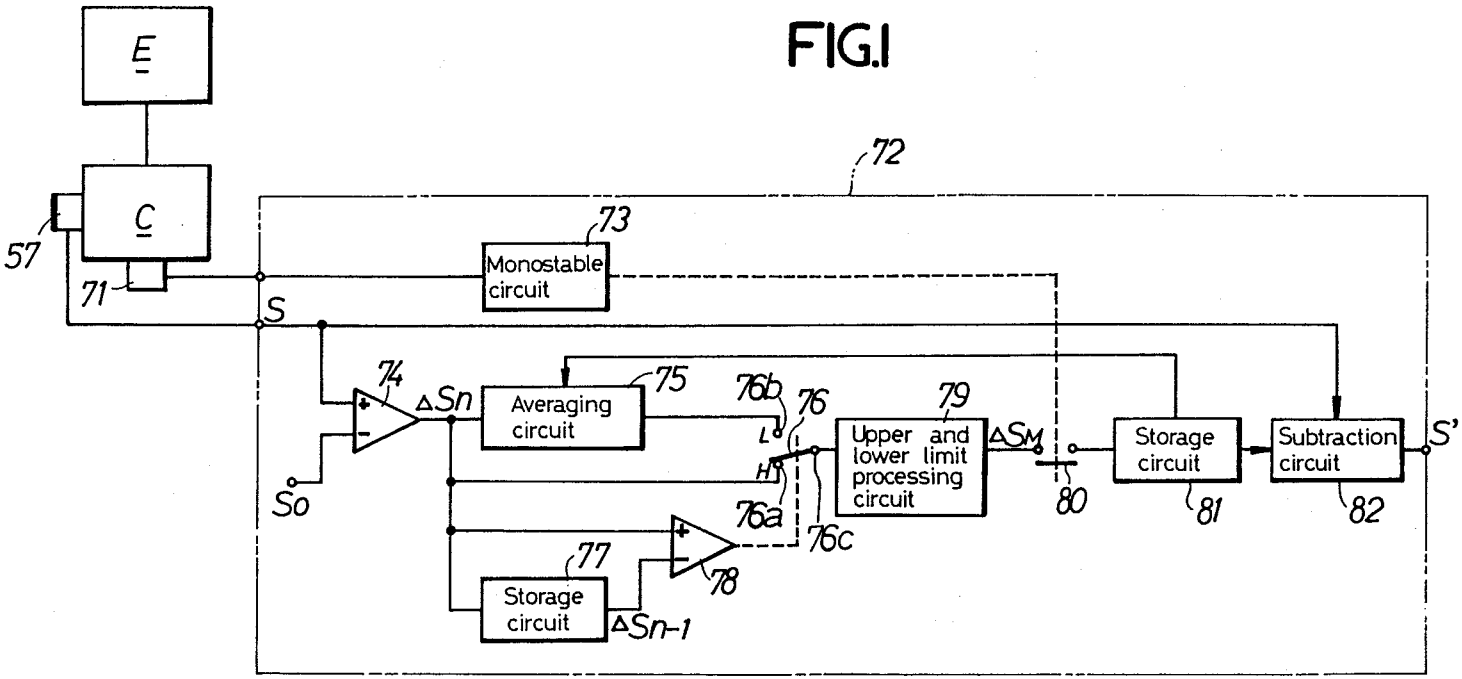
FIG. 1 is a block diagram illustrating the construction of correcting means.

The present invention will now be described by way of one embodiment with reference to the accompanying drawings. Referring first to FIG. 1, a variable displacement type compressor C is used for compression of a refrigerant gas, for example, in an air conditioner for a vehicle, and is driven by an internal combustion engine E. The compressor C can be varied in discharge volume by a variation in stroke of a working piston 13 (see FIG. 2). A stroke detecting means 57 is provided for detecting the stroke of the working piston 13, and a pressure switch 71 as switching means is provided for detecting a discharge pressure corresponding to the stroke. The detected value from the stroke detecting means is corrected by correcting means 72 when the switching mode of the pressure switch 71 is changed.

Figure 2:
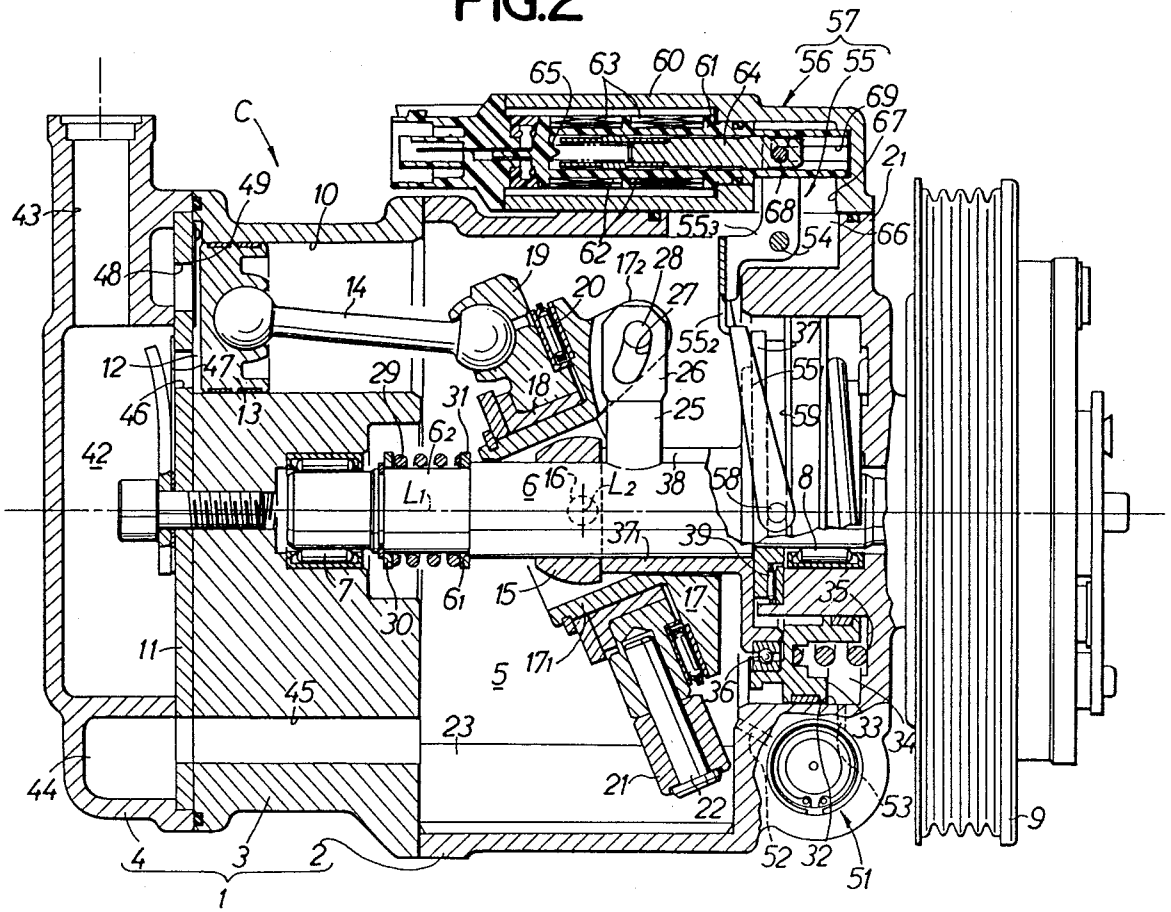
FIG. 2 is a longitudinal sectional view of a variable displacement type compressor.

Referring to FIG. 2, the structure of the variable displacement type compressor C will be described in detail. A casing 1 for the compressor C is formed by integral coupling of a basically bottomed cylindrical casing body 2, a cylinder block 3 secured to an opened end face of the casing body 2, and a cylinder head 4 mounted on an end face of the cylinder block 3. A working chamber 5 is defined in the casing 1 by the casing body 2 and the cylinder block 3.

A rotatable driving shaft 6 is carried on the cylinder block 3 in the casing 1 and on a closed end wall $2_1$ of the casing body 2 through radial needle bearings 7 and 8. The driving shaft 6 lies on an axis L1 of the casing 1. A drive pulley 9 with a clutch therein is integrally connected to a projecting end of the driving shaft 6 projecting from the closed end wall $2_1$ of the casing 1. The pulley 9 is operatively connected to the internal combustion engine E and thus, the driving shaft 6 is rotatably driven by a driving force from the internal combustion engine E.

The cylinder block 3 has a plurality of cylinder bores 10 provided therein in parallel to the driving shaft 6. Each bore 10 is opened at one end into the working chamber 5. The cylinder bores 10 are disposed at distances equally spaced apart on a concentric circle about the axis L1. An end plate 11 is clamped between the cylinder head 4 and the cylinder block 3 to close the other end of each of the cylinder bores 10. A working piston 13 is slidably received in each cylinder bore 10 to define a pressure chamber 12 between it and the end plate 11. One spherical end of a connecting rod 14 is rotatably connected to a back of each of the working pistons 13 on the side of the working chamber 5, and the other spherical end of each of the connecting rod 14 reaches the inside of the working chamber 5 and is connected to a swingable swash plate 19 which will be described hereinafter.

In the working chamber 5, a sleeve 15 is axially slidably fitted over the driving shaft 6. A pair of left and right pivots 16 are integrally provided on the left and right opposite sides of the sleeve 15 and each have a center on an axis L2 perpendicular to the axis L1 of the driving shaft 6 (normal to the sheet surface of FIG. 2). A board-like holder 17 is carried on the left and right pivots 16 for swinging movement back and forth along the axis of the driving shaft 6. The swingable swash plate 19 is rotatably carried through a radial bearing 18 on a cylindrical portion $17_1$ of the holder 17 extending to surround the sleeve 15, and a needle thrust bearing 20 is interposed between the opposed surfaces of the swingable swash plate 19 and the holder 17. A detent member 21 is connected to an outer end of the swingable swash plate 19 by a connecting pin 22. A guide groove 23 is provided in an inner surface of the casing body 2 to extend in parallel to the driving shaft 6 between the cylinder block 3 and the end wall $2_1$ of the casing body within the working chamber 5. The detent member 21 is slidably engaged in the guide groove 23. The guide groove 23 and the detent member 21 prevent the swingable swash plate 19 from rotating about the axis L1.

The driving shaft 6 is integrally provided with a drive pin 25 projecting therefrom and having a radially extending axis. The drive pin 25 has a connecting arm 26 integrally provided on its leading end and having an arcuate engagement hole 27 in which is a slidably engaged pin 28 which is integrally provided on a mounting piece $17_2$ of the holder 17 to project therefrom. The arcuate engagement hole 27 permits the swinging movement of the swingable swash plate 19 about the pivots 16 within an extent of its length. The holder 17 is rotated in response to rotation of the driving shaft 6.

The spherical ends of the connecting rods 14 connected to the working pistons 13 are rotatably connected to one surface of the swingable swash plate 19, as described above. Therefore, the operation stroke, and consequently the discharge amount of the working piston 13 is determined depending upon the angular displacement of the swingable swash plate 19 about the axis L2 of the pivots 16.

The driving shaft 6 is formed, at its end closer to the cylinder block 3, with a smaller diameter shaft portion $6_2$ through a locking stepped portion $6_1$. A coiled compression spring 29 is wound around the smaller diameter shaft portion $6_2$. The coiled compression spring 29 is engaged at one end thereof with a spring seat 30 fitted and locked over the smaller diameter shaft portion $6_2$, and at the other end thereof with an annular stopper 31 locked over the locking stepped portion $6_1$. The stopper 31 functions to engage one end face of the sleeve 15 to compress the coiled compression spring 29, when the sleeve 15 slides leftwardly as viewed in FIG. 2.

An annular bottomed slide bore 32 opened toward the working chamber 5 is centrally provided in the end wall $2_1$ of the casing body 2 in a concentric relation to the driving shaft 6. An annular control piston 33 is slidably received in the slide bore 32. A control pressure chamber 34 is defined between the control piston 33 and a closed end of the slide bore 32. A coiled compression spring 35 is contained in the control pressure chamber 34 for biasing the control piston 33 toward the working chamber 5.

The control piston 33 rotatably carries a control plate 37 at the end of the piston closer to the working chamber 5 with an angular ball bearing 36 interposed therebetween. The control plate 37 is integrally provided with a cylindrical portion $37_1$ which axially extends to surround the driving shaft 6 and has its end face engaged with an end face of the sleeve 15 by a repulsive force of the coiled compression spring 35. The cylindrical portion $37_1$ also has an axially extending slit 38 made therein. The drive pin 25 extends through the slit 38, and the control plate 37 is rotated in unison with the driving shaft 6 while permitting the axial movement of the control plate 37.

A thrust needle bearing 39 is interposed between a back of the control plate 37 and the end wall $2_1$ of the casing body 2. If the control piston 33 slides leftwardly or rightwardly, the sleeve 15 axially moves following the control piston 33, and correspondingly, the angular displacement of the holder 17 and the swingable swash plate 19 about the pivots 16 varies. More specifically, when the control piston 33 has moved leftwardly as viewed in FIG. 2, the sleeve 15 also moves leftwardly, and the holder 17 and the swingable swash plate 19 are swung clockwisely in correspondence to the movement of the control piston 33, resulting in smaller sliding stroke of each working piston 13. On the other hand, when the control piston 33 has moved rightwardly, the sleeve 15 also moves rightwardly under the influence of a working pressure on the working pistons 13 exerted through the connecting rods 14, the swash plate 19 and the holder 17. Correspondingly, the holder 17 and the swingable swash plate 19 are swung counterclockwisely as viewed in FIG. 2, resulting in a larger operating stroke of the working pistons 13.

A discharge chamber 42 is defined between the cylinder head 4 and the end plate 11, and a discharge passage 43 provided in the cylinder head 4 is connected to the discharge chamber 42. The pressure switch 71 is interposed at the middle of a line (not shown) leading from the discharge passage 43. An intake chamber 44 is defined between the cylinder head 4 and the end plate 11 to surround the discharge chamber 42 and is connected to the working chamber 5 through a communication passage 45 made in the cylinder block 3. Further, an intake passage (not shown) made in a wall of the casing body 2 is connected to the working chamber 5.

The end plate is provided with a plurality of discharge ports 46, one for each pressure chamber, which permits the communication of the discharge chamber 42 with the pressure chambers 12. A discharge valve 47 is mounted in each discharge port 46 and is adapted to open the discharge port 46 when the working piston 13 is in a compressing operation. The end plate 11 is further provided with a plurality of intake ports 48, one for each pressure chamber, which permit the communication of the intake chamber 44 with the pressure chambers 12. An intake valve 49 is mounted in each intake port 48 and is adapted to open the intake port 48 when the working piston 13 is in an intake operation.

As the plurality of working pistons 13 reciprocate in sequence through a intake stroke, the refrigerant passes from the intake passage through the working chamber 5, and the communication passage 45 into the intake chamber 44 and then, it opens the individual intake valves 49 in sequence and is drawn into the respective pressure chambers 12. In the compressing stroke of the respective piston 13, the compressed refrigerant in the individual pressure chamber 12 opens the corresponding discharge valve 47 and is passed under pressure from the discharge chamber 42 into the discharge passage 43.

A control valve 51 is disposed in the end wall $2_1$ of the casing body 2 in the casing 1 for providing the pressure control for the control pressure chamber 34. The control valve 51 is interposed between a discharge passage (not shown) leading to the discharge chamber 42 and an intake passage 52 leading to the intake chamber 44 through the working chamber 5 and through the communication passage 45, as well as a control passage 53 leading to the control pressure chamber 34. The control valve 51 is adapted to increase the pressure in the control pressure chamber 34 in response to the reduction of pressure in the intake chamber 44 when the cooling load of the air conditioner is reduced, whereby the control piston 33 is moved leftwardly as viewed in FIG. 2, causing the holder 17 and the swingable swash plate 19 to swing in a clockwise direction, resulting in a smaller operation stroke of each working piston 13, on the one hand, and to reduce the pressure in the control pressure chamber 34 in response to the increase of the pressure in the intake chamber 44 when such cooling load is increased, whereby the control piston 33 is moved rightwardly as viewed in FIG. 2, causing the holder 17 and the swingable swash plate 19 to tilt down counterclockwisely as viewed in FIG. 2, resulting in a larger operation stroke of each working piston 13, on the other hand.

In order to detect the operation stroke of each working piston 13, a stroke detecting means 57 is disposed in the compressor C and comprises an interlocking member 55 supported at its middle portion on the casing 1 by a support shaft 54 parallel to the axis L2 and perpendicular to the axis L1 of the driving shaft 6. The interlocking member 55 is connected at one end thereof to the control piston 33. A position detector 56 is disposed in the casing 1 to detect the position of the other end of the interlooking member 55.

As shown in FIG. 2, the interlocking member 55 is comprised of a semicircular portion $55_1$ extending astride the control piston 33, a connecting plate portion $55_2$ linked to a circumferentially central portion of the semicircular portion $55_1$, and a pair of opposed plate portions $55_3$ perpendicularly linked to the connecting plate portion $55_2$ in an opposed relation. Inwardly projecting pins 58 are mounted on circumferentially opposite ends of the semicircular portion $55_1$, respectively and are engaged in an annular engagement groove 59 provided in an outer surface of the control piston 33, respectively, whereby one end of the interlocking member 55 is connected to the control piston 33. The support shaft 54 inserted through the opposed plate portions $55_3$ is supported on the casing 1, whereby the middle portion of the interlocking member 55 is supported on the casing 1.

The position detector 56 is a differential transformer and comprises a basically cylindrical housing 60, a bobbin 61 basically cylindrically formed of a synthetic resin and fixed within the housing 60, secondary coils 62, 62 wound around an outer periphery of the bobbin 61 at two axially spaced-apart places, respectively, primary coils 63, 63 wound around outer peripheries of the secondary coils 62, 62, respectively, a core 64 axially movably received in the bobbin 61, and a spring 65 interposed between the bobbin 61 and the core 64 for biasing the core 64 axially outwardly (rightwardly as viewed in FIG. 2). The housing 60 is fixed to the outer surface of the casing body 2 in parallel to the axis L1 of the driving shaft 6.

An opening 66 is provided in the casing body 2 at its portion corresponding to the position detector 56, and an opening 67 is also provided in the housing 60 of the position detector 56 at its portion corresponding to the opening 66. The other end of the interlocking member 55 supported on the casing 1 by the support shaft 54, i.e., the opposed plate portions $55_3$, $55_3$, are inserted through the openings 66 and 67 into the housing 60 and disposed on opposite sides of the bobbin 61. A connecting pin 68 is fixed to an outer end of the core 64 to extend along one diametrical line and has its opposite ends projecting outwardly through an elongated hole 69 provided in the bobbin 61. The opposite ends of the connecting pin 68 are engaged with leading ends of the opposed plate portions $55_3$, respectively.

With such stroke detecting means 57, when the axial movement of the control piston 33 causes the interlocking member 55 to be swung about the support shaft 54, the core 64 is axially displaced with the change in position of the other end of the interlocking member 55, i.e., the leading ends of the opposed plate portions $55_3$, $55_3$. In a condition of a rectangular-wave input voltage having a given frequency and a given amplitude being applied to the primary coils 63, 63, the difference in AC voltage developed between the secondary coils 62, 62 is varied depending upon the axial displacement of the core 64. Therefore, it is possible to readily detect the axial position of the core 64, i.e., the axial position of the control position 33 through the interlocking member 55.

Referring again to FIG. 1, the pressure switch 71 is set so that the switching mode may be changed form an electrically disconnecting state to an electrically connecting state by sensing the discharge pressure from the variable displacement type compressor C in a condition of the largest stroke of the working piston 13. A signal which will become a higher level in response to the change of the switching mode is input from the pressure switch 71 to the correcting means 72, and a stroke-detected value S detected in the stroke detecting means 57 is also input to the correcting means 72.

The correcting means 72 comprises a monostable circuit 73, a differential amplifier circuit 74, an averaging circuit 75, a switch 76, a first storage circuit 77, a comparator circuit 78, an upper and lower limit processing circuit 79, a switch 80, a second storage circuit 81 and a subtraction circuit 82.

The monostable circuit 73 produces a higher level signal which is sustained for a given time t, e.g., for one second from a point when the output from the pressure switch 71 has become a higher level. Such higher level signal allows the switch 80 to conduct. The differential amplifier circuit 74 calculates a deviation Δ S between a reference value So set in correspondence to the full stroke of the working piston 13 and a detected value S obtained in the stroke detecting means 57. The switch 76 has a separate contact 76a connected to the differential amplifier circuit 74, a separate contact 76b connected to the averaging circuit 75, and a common contact 76c connected to the upper and lower limit processing circuit 79. The switch 76 is brought into a state where the separate contact 76a is electrically connected to the common contact 76c when the output from the comparator circuit 78 has become a higher level, while the switch is brought into a state where the separate contact 76b is electrically connected to the common contact 76c when the output from the comparator circuit 78 has become a lower level. On the other hand, an output from the differential amplifier circuit 74 is supplied to a non-inverted input terminal of the comparator circuit 78, and an output from the first storage circuit 77 is supplied to an inverted input terminal of the comparator circuit 78. The first storage circuit 77 has stored an output $\Delta S_{n-1}$ from the differential amplifier 74 at the last processing, and supplies such value $\Delta S_{n-1}$ to the comparator circuit 78 at the now processing.

The upper and lower processing circuit 79 provides a processing so that the value input through the switch 76 cannot exceed a preset upper and lower limit value $\Delta S_L$. A corrected value $\Delta S_M$ obtained in the upper and lower processing circuit 79 is input to the second storage circuit 81 through the switch 80 where the corrected value $\Delta S_M$ is once stored. Such stored value $\Delta S_M$ is used for averaging in the averaging circuit 75. Further, the corrected value $\Delta S_M$ input to the subtraction circuit 82 via the second storage circuit 81 is subtracted from the detected value S input from the stroke detecting means 57, thereby providing a corrected stroke value S' which is used in controlling means (not shown) for the engine E.

Figure 3:
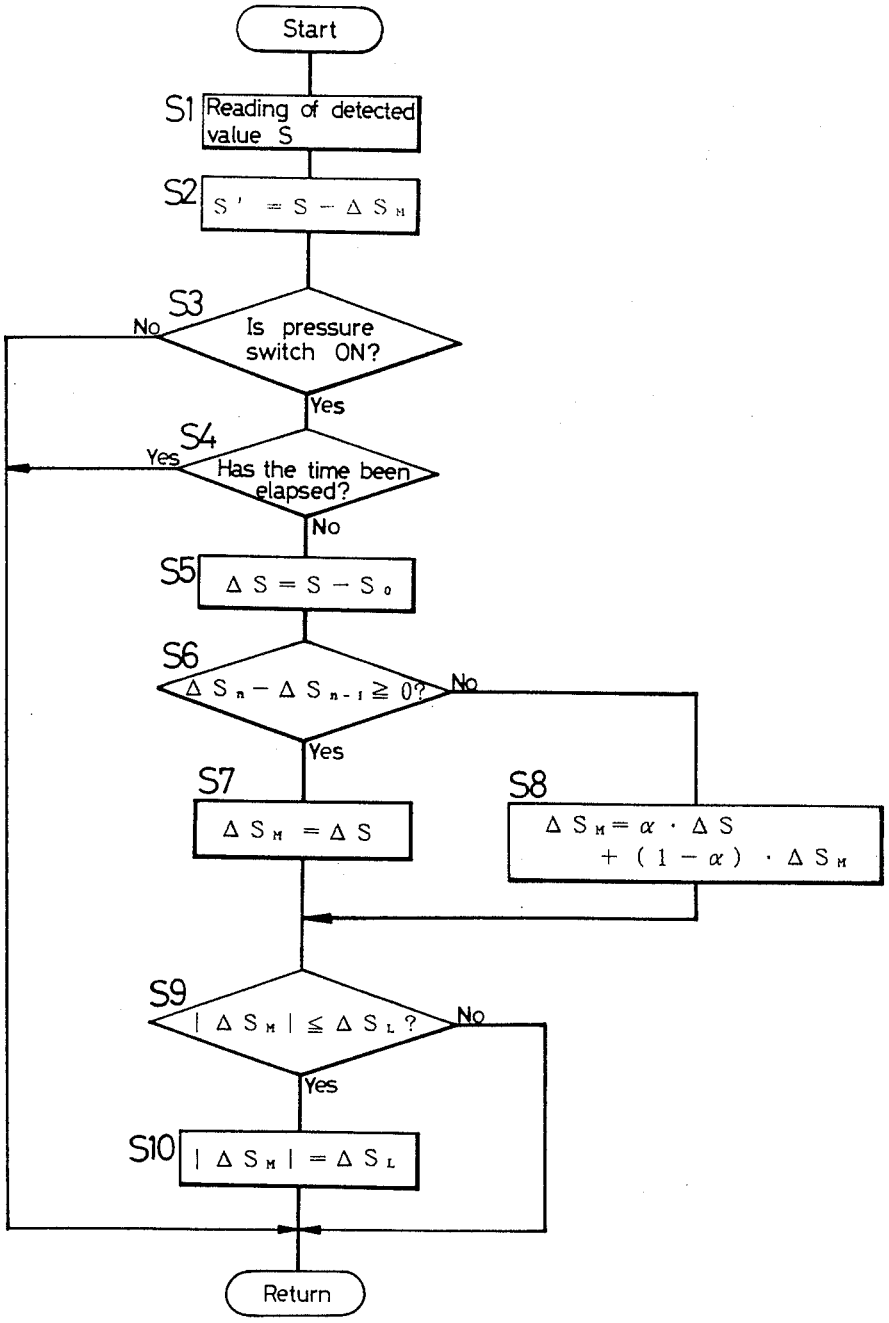
FIG. 3 is a flow chart illustrating a processing procedure for the correcting means.

The processing procedure in the correcting means 72 is put in order, as shown in FIG. 3. Specifically, in a first step $S_1$, the detected value S from the stroke detecting means 57 is read, and in a second step $S_2$, a calculation according to the following expression (1) is conducted in the subtraction circuit 82:

$$S' = S - \Delta S_M \quad (1)$$

In a third step $S_3$, it is decided whether the switching mode of the pressure switch 71 has been changed or not, i.e., whether the discharge pressure from the compressor C has been changed, then the processing is advanced to a fourth step $S_4$, whereas if the switching mode is not changed, then the processing is returned to the step $S_1$. In the fourth step $S_4$, it is decided whether a given time t has elapsed or not after the pressure switch 71 has been in conduction, i.e., whether the output from the monostable circuit 73 is at a higher level or not. If the given time t has elapsed, then the processing is returned to the first step $S_1$, whereas if the given time has not elapsed, then the processing is advanced to a fifth step $S_5$.

In the fifth step $S_5$, a calculation according to the following expression (2) is conducted in the differential amplifier circuit 74:

$$\Delta S = S - So \quad (2)$$

In a subsequent sixth step $S_6$, a processing is conducted in the comparator circuit 78, i.e., it is decided whether the following inequality is established or not:

$$\Delta S_n - \Delta S_{n-1} \geqq 0 \quad (3)$$

If the inequality is established, i.e., if the deviation between the detected values obtained in the stroke detecting means 57 tends to gradually increase, then the processing is advanced to a seventh step $S_7$. On the other hand, if the inequality is not established, then the processing is advanced to an eighth step $S_8$.

In the seventh step $S_7$, the output from the differential amplifier circuit 74 is input directly as a corrected value $\Delta S_M$ (=Δ S) to the upper and lower limit processing circuit 79 as a result of the output from the comparator circuit 78 being at a high level. In the eighth step $S_8$, an averaging according to the following expression (4) is conducted in the averaging circuit 75, and a corrected value $\Delta S_M$ is input to the upper and lower limit processing circuit 79:

$$\Delta S_M = \alpha \cdot \Delta S + (1-\alpha) \cdot \Delta S_M \quad (4)$$

Wherein α is a stroke value smothing coefficient.

After passing through the seventh and eighth steps $S_7$ and $S_8$, the processing is advanced to a ninth step $S_2$. The ninth step $S_9$ and a subsequent step $S_{10}$ provide a processing in the upper and lower processing circuit 79, and in the ninth step $S_9$, it is decided whether the following inequality is established or not:

$$|\Delta S_M| \leqq \Delta S_L \quad (5)$$

wherein $\Delta S_L$ is previously set as an upper and lower limit value for the corrected value. If the expression (5) is established, then $\Delta S_M$ is determined from an expression (6) in the tenth step $S_{10}$.

$$|\Delta S_M| = \Delta S_L \quad (6)$$

If the expression (5) is not established, then the processing is returned to the first step $S_1$.

The operation of this embodiment will be described below. The detected value S detected in the stroke detecting means 57 is corrected by a deviation $\Delta S_M$ from the reference value So. That is the deviation $\Delta S_M$ is calculated from the reference value So set in correspondence to the full stroke condition and the stroke value S is corrected by such $\Delta S_M$ in the correcting means 72, when the working piston 13 has become the full stroke condition and the pressure switch 71 has conducted (i.e., the discharge pressure is maximum). Therefore, regardless of an error of attachment of the stroke detecting means 57 to the variable displacement compressor C or a deterioration with age thereof, the detected value from the stroke detecting means 57 can be corrected to provide a stroke value substantially exactly corresponding to the actual stroke, thereby enabling a proper control of the idling rpm of the internal combustion engine E.

The correction in the correcting means 72 is conducted by the time when the given time t has elapsed after the switching mode of the pressure switch has been changed, and due to the variation in stroke of the working piston 13 occurring prior to the variation in discharge pressure, the working piston 13 is in the full stroke condition for the given time after changing of the switching mode of the pressure switch 71, and by effecting the correction of the stroke detected value during such time, a good accuracy correction can be provided.

In the above embodiment, the construction is such that the switching mode of the pressure switch 71 is changed with the full stroke of the working piston 13, i.e., with the maximum discharge pressure, but it will be understood that the switching mode of the pressure switch 71 may be changed with a middle stroke between zero and full strokes. In this case, the reference value So may be set at a value corresponding to that middle stroke.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A stroke detection correcting device for variable displacement type compressors, comprising:

a variable displacement type compressor including a plurality of working pistons operatively connected to an internal combustion engine and variable in stroke;

stroke detecting means for detecting the operation stroke of the working pistons;

switching means for changing the switching mode when the stroke of each working piston is in a given range previously set; and correcting means for correcting the detected value from said stroke detecting means on the basis of a predetermined value in accordance with the changing of the switching mode of said switching means.

2. A stroke detection correcting device for variable displacement type compressors according to claim 1, wherein said switching means is a pressure switch whose switching mode is changed when the discharge pressure from the variable displacement type compressor is more than a given value.

3. A stroke detection correcting device for variable displacement type compressors according to claim 2, wherein said switching means is arranged so that the switching mode is changed with the maximum discharge pressure from the variable displacement type compressor, and said correcting means is arranged so that the detected value is corrected by the time when a given time has elapsed from the changing of the switching mode of said switching means.

* * * * *